US008614039B2

(12) United States Patent
Nair et al.

(10) Patent No.: US 8,614,039 B2
(45) Date of Patent: Dec. 24, 2013

(54) TONER CONTAINING METALLIC FLAKES AND METHOD OF FORMING METALLIC IMAGE

(75) Inventors: Mridula Nair, Penfield, NY (US); Xiqiang Yang, Webster, NY (US); Joseph S. Sedita, Albion, NY (US)

(73) Assignee: Eastman Kodak Company, Rochester, NY (US)

( * ) Notice: Subject to any disclaimer, the term of this patent is extended or adjusted under 35 U.S.C. 154(b) by 595 days.

(21) Appl. No.: 12/766,939

(22) Filed: Apr. 26, 2010

(65) Prior Publication Data

US 2011/0262858 A1 Oct. 27, 2011

(51) Int. Cl.
*G03G 9/09* (2006.01)
*G03G 9/097* (2006.01)

(52) U.S. Cl.
USPC ..... 430/108.1; 430/108.3; 430/108.8

(58) Field of Classification Search
USPC ..... 430/108.1, 108.3, 123.5, 124.1, 137.17, 430/108.8
See application file for complete search history.

(56) References Cited

U.S. PATENT DOCUMENTS

| | | | | |
|---|---|---|---|---|
| 5,180,650 | A | 1/1993 | Sacripante et al. | |
| 7,326,507 | B2 | 2/2008 | Schulze-Hagenest et al. | |
| 2003/0151028 | A1* | 8/2003 | Lawrence et al. | 252/500 |
| 2008/0176157 | A1* | 7/2008 | Nair et al. | 430/108.21 |
| 2009/0111040 | A1* | 4/2009 | Veregin et al. | 430/108.3 |
| 2010/0021838 | A1 | 1/2010 | Putnam et al. | |
| 2011/0262654 | A1 | 10/2011 | Yates et al. | |

FOREIGN PATENT DOCUMENTS

| | | |
|---|---|---|
| EP | 1 124 165 | 8/2001 |
| EP | 1 744 223 | 1/2007 |
| JP | 2005-134738 | 5/2005 |
| WO | 2005/076086 | 8/2005 |
| WO | 2008/088697 | 7/2008 |
| WO | 2008/088700 | 7/2008 |
| WO | 2009/080087 | 7/2009 |
| WO | 2010/011297 | 1/2010 |

* cited by examiner

*Primary Examiner* — Jonathan Jelsma
(74) *Attorney, Agent, or Firm* — Andrew J. Anderson; Raymond L. Owens

(57) ABSTRACT

The present invention relates to a porous toner particle with encapsulated metallic flakes. The porous particle containing metallic flakes can be useful for reproduction of a metallic hue upon fusing to a substrate, preferably golden or silvery hue, and for manufacturing of printed circuits, by a printing process, especially electrophotography.

10 Claims, 1 Drawing Sheet

TONER CONTAINING METALLIC FLAKES AND METHOD OF FORMING METALLIC IMAGE

FIELD OF THE INVENTION

This invention relates to electrostatographic toners, more particularly to porous toner particles with encapsulated metallic flakes for use in the reproduction of printed images having metallic hues, and for production of printing circuit boards, by a printing process such as electrophotography.

BACKGROUND OF THE INVENTION

Electrophotographic images are typically produced by first uniformly charging a primary imaging member such as a photoconducting web or drum using known means such as a corona or roller charger. An electrostatic latent image is then formed by image-wise exposing the primary imaging member using known means such as optical exposure, laser scanners, or LED arrays. The electrostatic latent image is then rendered into a visible image by bringing the electrostatic latent image into close proximity to marking particles, alternatively referred to as toner particles, which have been electrically charged so that they will be attracted to the regions of the primary imaging member bearing the electrostatic latent image. Charging the marking particles, which may or may not comprise a colorant such as a dye or a pigment, and bringing the particles into close proximity with the primary imaging member, is generally accomplished using a magnetic brush development station. The marking particles are first rendered suitable for use in a magnetic brush development station by mixing the marking particles with so-called carrier particles. The carrier particles comprise suitable material that will be attracted to the magnets in the magnetic brush development station and may comprise known materials such as ferrites or iron oxides, etc. The carrier particles often comprise various charge agents that impart a controlled charge on the marking particles. The marking particles may also comprise suitable charge control agents so that, upon mixing with the carrier particles, the marking particles obtain an electrical charge of suitable magnitude and sign so as to make them attractive in the proper amounts to the electrostatic latent image in suitable quantities to enable various image densities to be developed in the electrostatic latent image.

In magnetic brush development, toner particles are generally mixed in the sump of the magnetic brush development station with carrier particles to a predetermined level that is measured with a toner concentration monitor. The marking particles are charged by contacting the carrier particles and brought into close proximity to the primary imaging member bearing the electrostatic latent image by rotating the cylindrical shell, the coaxial magnetic core, or both of the magnetic brush development station. The brush is electrically biased in such a manner that, depending on the sign of the charge of the toner particles, the marking particles can be deposited onto the primary imaging member in either the electrically charged or the electrically discharged regions to render the electrostatic latent image visible.

The toned image is next transferred to a receiver, which could be either a final receiver material such as paper, transparency, etc. or to an intermediate transfer member, such as a compliant intermediate transfer member, and then from the intermediate transfer member to the final receiver member. Transfer can be accomplished by applying pressure between the receiver and either the primary imaging member or the intermediate transfer member. More commonly, pressure is applied in conjunction with either an applied electrostatic field or with heat that softens the toner particles. The image is then typically permanently fixed to the final receiver member using pressure, heat, or solvent vapors. Most commonly, the image is fixed to the final receiver by pressing the image-bearing final receiver member against a heated fuser roller. To prevent the final receiver member from adhering to the heated fuser roller, the heated fuser roller is conventionally first coated with a release agent such as a silicone oil. Alternatively, release agents, and in particular wax particles, may be incorporated into toner particles to facilitate release of a fused toner image from the heated fuser roller.

In such systems, it is important that marking particles be electrically insulating when used in conjunction with magnetic brush development and electrostatic transfer. If the particles are not electrically insulating, their charges can change when in contact with the receiver or in the development station. This could impair transfer and development as the applied electrostatic force used to urge the marking particles towards the primary imaging member or to or from a receiver member would vary with the charge on the marking particles. Moreover, even if the charge did not reverse sign or become so significantly altered so as to prevent development or transfer, the control of either or both of these operations could be impeded, resulting in incorrect amounts of marking particles being deposited, with corresponding undesirable density variations and other artifacts occurring.

Printing processes serve not only to reproduce and transmit objective information, but also to convey esthetic impressions, for example when coffee-table books are printed or else in pictorial advertising. An immense problem here is posed in particular by the reproduction of metallic hues. Metallic hues are only imperfectly reproducible by a color mixture formed from primary colors, especially the colors cyan, magenta, yellow, and black (CMYK). A gold tone is particularly difficult to reproduce by means of such a color mixture. It has therefore been proposed to incorporate metallic pigments or particles in printing ink in order that a metallic color may be brought about directly. This in practice has been used in many commercial liquid printing inks. But in the case of electrophotographic toners, where magnetic and/or electrical and especially electrostatic properties are decisive, this is particularly problematic, since metallic constituents may have an adverse effect on these properties.

Nevertheless there have already been proposals in the art to imbue toners with metallic constituents. For instance, U.S. Pat. No. 5,180,650 discloses providing a toner composition, which contains lightly colored metallic constituents, such as copper, silver, or gold for example, in a coating, which in turn has been provided with an over-coating comprised of a metal halide. But the appearance of prints in particular may be adversely affected by chemical reactions of the metallic constituents due to the halides, which can promote oxidations of the constituents for example. For instance, the tarnishing with which everyone is familiar from copper or silver objects may occur, making the metallic quality unattractive or disappear completely. Moreover, these toners are only lightly metallically colored, which is insufficient to reproduce a gold tone in printed matter.

Further, when metallic constituents are incorporated in toners using conventional manufacturing processes, these metallic flakes are typically randomly oriented throughout the toner particles. This random orientation leads to the loss of metallic hue, and causes a rather dark appearance when such toners are fixed to a receiver sheet using heated fusing rollers.

More recently, there have been proposals to modify the surface of metallic flakes such that it becomes hydrophobic and non-conductive, in order to be used in electrophotography. U.S. Pat. No. 7,326,507, incorporated herein by reference for all that it contains, discloses the preparation of a toner for producing a metallic hue. Metallic pigment particles are coated with a silicate followed by an organic layer, and the resulting particles are combined with toner materials. However, the toner was not shown to contain encapsulated metallic flakes in the polymeric resin. Thus, there is a possibility that the metallic pigment itself may be detached from the polymer during the particle making process, resulting in inhomogeneities in the toner that can cause transfer and cleaning problems.

SUMMARY OF THE INVENTION

It is an object of the present invention to provide toner polymeric particles that may contain high concentrations of encapsulated metallic flakes.

It is further an object of the present invention to provide porous toner particles that contain encapsulated metallic flakes that can effectively produce metallic hue by a printing processes such as electrophotography or electrography upon fusing of the toner particles to a receiver substrate.

It is yet another object of the present invention to provide porous polymeric particles with encapsulated conductive metal flakes for printing circuit boards using a process such as electrophotography or electrography.

It is a further object of the present invention to provide a scalable and efficient process for the production of the above toner particles.

It is a further object of the invention to provide a method for producing an electrophotographic toner image with enhanced metallic hue and luster or sheen effect.

It is still another object of the present invention to directly utilize commercial metallic flakes in such particles and methods so that further surface modifications are not needed.

These and other objects can be achieved according to the present invention described herein.

In one embodiment, the invention is directed towards a toner particle having an external particle surface and comprising a polymer binder phase and metallic flakes encapsulated therein, wherein the toner particle further comprises discrete pores formed within the toner particle, such that the toner particle has an internal porosity of at least 10 percent by volume.

In another embodiment, the invention is directed towards a method of making such toner particles comprising: providing a first aqueous phase comprising dispersed metallic flakes; dispersing the first aqueous phase in an organic solution containing a polymer binder to form a first emulsion; dispersing the first emulsion in a second aqueous phase to form a second emulsion; shearing the second emulsion in the presence of a particulate stabilizing agent to form droplets of the first emulsion in the second aqueous phase; and evaporating the organic solution from the droplets to form porous toner particles having metallic flakes encapsulated therein.

In another embodiment, the invention is directed towards a method for forming a toner image comprising: forming a toner image on a substrate, wherein the toner image comprises toner particles according to the invention comprising porous toner particles having metallic flakes encapsulated therein; and fixing the toner particles to the substrate by application of heat to fuse the toner particles to the substrate, wherein pores within the toner particles provide space for the metallic flakes to re-orient within the toner particle binder phase to be relatively more parallel with the receiver substrate surface upon fusing. The porous structure of the toner particle further enables use of a lower amount of binder compared to solid particles, enabling thinner fused images, further enhancing alignment of the metallic flakes with the substrate surface upon fusing.

Figure 1:
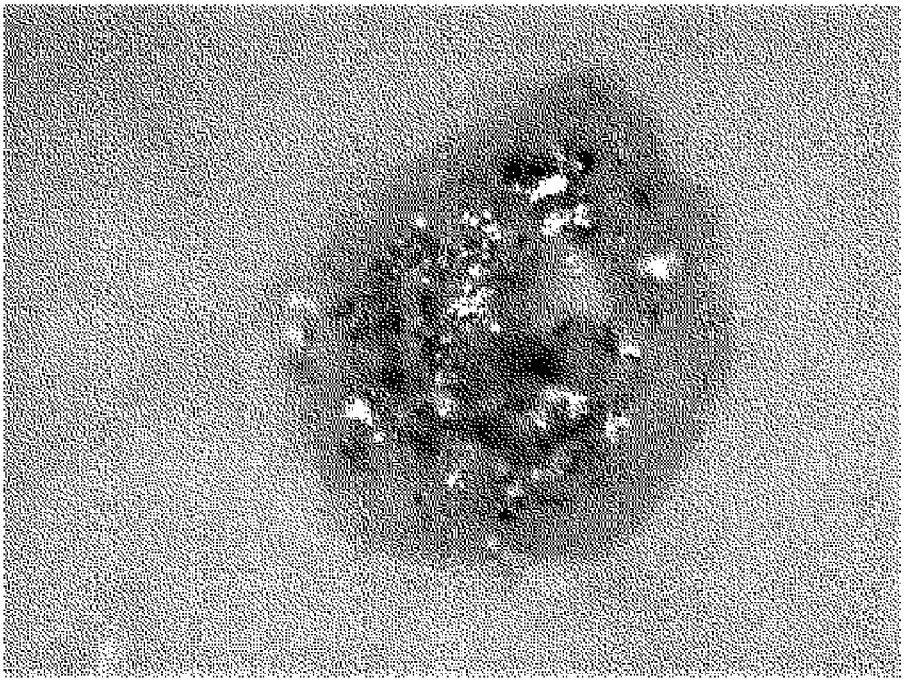
FIG. 1 is a reflective optical image of a fused toner particle formed from a comparison solid toner particle comprising metallic flakes.

For a better understanding of the present invention, together with other advantages and capabilities thereof, reference is made to the following detailed description in connection with the above-described drawings.

DETAILED DESCRIPTION OF THE INVENTION

The present invention provides a toner for reproduction of a metallic, preferably golden or silvery, hue by a printing process, especially for electrophotography, distinguished by at least one porous particle which comprises at least one metallic flake-like pigment. The desirability of employing such a toner has already been described. In accordance with the present invention, voids are introduced into the toner particle to form a porous particle, and the voids provide space for the flake-like metallic pigments to re-orient within the binder upon high temperature fusing, yielding prints that exhibit a higher metallic hue and luster or sheen effect.

The inventive toner may be applied to a substrate (receiver) by a digital printing process, preferably an electrostatic printing process, more preferably by an electrophotographic printing process, such as described, e.g., in L. B. Schein, Electrophotography and Development Physics, 2nd Edition, Laplacian Press, Morgan Hill, Calif., 1996 (ISBN 1-885540-02-7); or, by a coating process, preferably an electrostatic coating process, more preferably by an electromagnetic brush coating process as described in U.S. Pat. No. 6,342,273, the disclosure of which is hereby incorporated by reference thereto. For fixing of the toner to the surface of the substrate a contact fusing method like heated roller fusing may preferably be used, or a non-contact fusing method like an oven, hot air, radiant, flash, solvent, or microwave fusing.

Toner particles of the invention have an external particle surface and comprise a polymer binder phase and metallic flakes encapsulated therein. Discrete pores are formed within the toner particle, such that the toner particle has an internal porosity of at least 10 percent by volume. The porous toner particles of the present invention may include "micro," "meso," and "macro" pores which according to the International Union of Pure and Applied Chemistry are the classifications recommended for pores less than 2 nm, 2 to 50 nm, and greater than 50 nm, respectively. The term porous particles will be used herein to include pores of all sizes, including open or closed pores.

In accordance with one embodiment, a porous toner particle encapsulating metallic flakes in accordance with the present invention may be produced through a water-in-oil-in-water double emulsion process of the type described, e.g., in US Patent Publications 2008/0176157, 2008/0176164, and 2010/0021838, the disclosures of which are incorporated by reference herein. Such double emulsion process involves basically a three-step process. The first step involves the formation of a stable water-in-oil emulsion, including a first aqueous solution dispersed finely in a continuous phase of a binder polymer dissolved in an organic solvent. In accordance with this particular embodiment, this first dispersed water phase ultimately creates the pores in the particles. A pore stabilizing compound may be included in the first aqueous solution, to control the pore size and number of pores in the particle, while stabilizing the pores such that the final particle is not brittle or fractured easily. Pore stabilizing hydrocolloids include both naturally occurring and synthetic, water-soluble or water-swellable polymers such as, cellulose derivatives e.g., Carboxymethyl Cellulose (CMC) also referred to as sodium carboxy methyl cellulose, gelatin e.g., alkali-treated gelatin such as cattle bone or hide gelatin, or acid treated gelatin such as pigskin gelatin, gelatin derivatives e.g., acetylated gelatin, phthalated gelatin, and the like, substances such as proteins and protein derivatives, synthetic polymeric binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, water soluble microgels, polyelectrolytes, ionomers, and mixtures thereof.

In order to stabilize the initial first step water-in-oil emulsion so that it can be held without ripening or coalescence, if desired, it is preferable that the hydrocolloid in the water phase have a higher osmotic pressure than that of the binder in the oil phase depending on the solubility of water in the oil. This dramatically reduces the diffusion of water into the oil phase and thus the ripening caused by migration of water between the water droplets. One can achieve a high osmotic pressure in the water phase either by increasing the concentration of the hydrocolloid or by increasing the charge on the hydrocolloid (the counter-ions of the dissociated charges on the hydrocolloid increase the osmotic pressure of the hydrocolloid). It can be advantageous to have weak base or weak acid moieties in the pore stabilizing hydrocolloid that allow for the osmotic pressure of the hydrocolloid to be controlled by changing the pH. We will call these hydrocolloids "weakly dissociating hydrocolloids." For these weakly dissociating hydrocolloids the osmotic pressure can be increased by buffering the pH to favor dissociation, or by simply adding a base (or acid) to change the pH of the water phase to favor dissociation. A preferred example of such a weakly dissociating hydrocolloid is CMC that has a pH sensitive dissociation (the carboxylate is a weak acid moiety). For CMC the osmotic pressure can be increased by buffering the pH, for example using a pH 6-8 phosphate buffer, or by simply adding a base to raise the pH of the water phase to favor dissociation (for CMC the osmotic pressure increases rapidly as the pH is increased from 4-8).

Other synthetic polyelectrolytes hydrocolloids such as polystyrene sulphonate (PSS) or poly(2-acrylamido-2-methylpropanesulfonate) (PAMS) or polyphosphates are also possible hydrocolloids. These hydrocolloids have strongly dissociating moieties. While the pH control of osmotic pressure that can be advantageous, as described above, is not possible due to the strong dissociation of charges for these strongly dissociating polyelectrolyte hydrocolloids, these systems will be insensitive to varying level of acid impurities. This is a potential advantage for these strongly dissociating polyelectrolyte hydrocolloids particularly when used with binder polymers that have varying levels of acid impurities such as polyesters.

Desired properties of the pore stabilizing hydrocolloids include solubility in water, no negative impact on multiple emulsification process, and no negative impact on melt rheology of the resulting particles when they are used as electrophotographic toners. The pore stabilizing compounds can be optionally cross-linked in the pore to minimize migration of the compound to the surface affecting triboelectrification of the toners. The amount of the hydrocolloid used in the first step will depend on the amount of porosity and size of pores desired and the molecular weight of the hydrocolloid. A particularly preferred hydrocolloid is CMC and in an amount of from 0.5-20 weight percent of the binder polymer, preferably in an amount of from 1-10 weight percent and more preferably in an amount of from 2-10 weight percent of the binder polymer.

The first aqueous phase may additionally contain, if desired, salts to buffer the solution and to optionally control the osmotic pressure of the first aqueous phase as described earlier. For CMC the osmotic pressure can be increased by buffering using a pH 7 phosphate buffer. It may also contain additional porogen or pore forming agents such as ammonium carbonate.

The double emulsion process embodiment is applicable to the preparation of porous polymeric toner particles from any type of binder polymer or binder resin that is capable of being dissolved in a solvent that is immiscible with water wherein the binder itself is substantially insoluble in water. Useful binder polymers include those derived from vinyl monomers, such as styrene and acrylic monomers, and condensation monomers such as esters and mixtures thereof. As the binder polymer, known binder resins are useable. Concretely, these binder resins include homopolymers and copolymers such as polyesters and polymers derived from styrenes, e.g. styrene and chlorostyrene; monoolefins, e.g. ethylene, propylene, butylene and isoprene; vinyl esters, e.g. vinyl acetate, vinyl propionate, vinyl benzoate and vinyl butyrate; a-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers, e.g. vinyl methyl ether, vinyl ethyl ether and vinyl butyl ether; and vinyl ketones, e.g. vinyl methyl ketone, vinyl hexyl ketone and vinyl isopropenyl ketone; and mixtures thereof. Particularly desirable binder polymers/resins include polystyrene resin, polyester resin, copolymers derived from styrene and acrylic monomers such as styrene/alkyl acrylate copolymers and styrene/alkyl methacrylate copolymers, styrene/acrylonitrile copolymer, styrene/butadiene copolymer, styrene/maleic anhydride copolymer, polyethylene resin, and polypropylene resin. They further include polyurethane resin, epoxy resin, silicone resin, polyamide resin, modified rosin, paraffins, and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol, and bisphenol adducts of ethylene or propylene oxides. Specific examples are described in U.S. Pat. Nos. 5,120,631; 4,430,408; and 5,714,295, all incorporated herein by reference, and include propoxylated bisphenol-A fumarate, such as FINETONE 382 ES from Reichold Chemicals, formerly ATLAC 382 ES from ICI Americas Inc.

Preferably the acid values (expressed as milligrams of potassium hydroxide per gram of resin) of the polyester resins are in the range of from 2 to 100. The polyesters may be saturated or unsaturated. Of these resins, poly(styrene-co-acrylate) and polyester resins are particularly preferable.

In the practice of this invention, it is particularly advantageous to utilize resins having a viscosity in the range of from 1 to 200 centipoise when measured as a 20 weight percent solution in ethyl acetate at 25° C.

Any suitable solvent that will dissolve the binder polymer and which is also immiscible with water may be used in the double emulsion process embodiment of this invention such, as for example, chloromethane, dichloromethane, ethyl acetate, vinyl chloride, trichloromethane, carbon tetrachloride, ethylene chloride, trichloroethane, toluene, xylene, cyclohexanone, 2-nitropropane, and the like. Particularly useful solvents are ethyl acetate and propyl acetate for the reason that they are both effective solvents for many polymers while at the same time being sparingly soluble in water. Further, their volatility is such that they are readily removed from the discontinuous phase droplets as described below, by evaporation.

Optionally, the solvent that will dissolve the binder polymer and which is immiscible with water may be a mixture of two or more water-immiscible solvents chosen from the list given above. Optionally the solvent may comprise a mixture of one or more of the above solvents and a water-immiscible nonsolvent for the binder polymer such as heptane, cyclohexane, diethylether, and the like, that is added in a proportion that is insufficient to precipitate the binder polymer prior to drying and isolation.

The second step in the formation of the porous particles in accordance with the double emulsion process involves forming a water-in-oil-in-water emulsion by dispersing the above mentioned water-in-oil emulsion in a second aqueous phase containing either stabilizer polymers such as polyvinyl pyrrolidone or polyvinyl alcohol, or more preferably colloidal silica such as LUDOX or NALCO or latex particles in a modified ELC process such as described in U.S. Pat. Nos. 4,833,060; 4,965,131; 2,934,530; 3,615,972; 2,932,629; and 4,314,932, the disclosures of which are hereby incorporated by reference.

Specifically, in the second step, the water-in-oil emulsion is preferably mixed with a second aqueous phase containing colloidal silica stabilizer to form an aqueous suspension of droplets that is subjected to shear or extensional mixing or similar flow processes, preferably through an orifice device to reduce the droplet size, yet above the particle size of the first water-in-oil emulsion, and achieve narrow size distribution droplets through the limited coalescence process. The pH of the second aqueous phase is generally between 4 and 7 when using silica as the colloidal stabilizer.

The resulting suspension of droplets of the first water-in-oil emulsion in the second aqueous phase forms a double emulsion containing the first aqueous phase as finer droplets within the bigger binder polymer/resin solution droplets, which upon drying produces porous domains in the resultant particles of binder polymer/resin. The actual amount of silica used for stabilizing the droplets depends on the size of the final porous particle desired as with a typical limited coalescence process, which in turn depends on the volume and weight ratios of the various phases used for making the multiple emulsion.

Any type of mixing and shearing equipment may be used to perform the first step described above, such as a batch mixer, planetary mixer, single or multiple screw extruder, dynamic or static mixer, colloid mill, high pressure homogenizer, sonicator, or a combination thereof. While any high shear type agitation device is applicable to this step, a preferred homogenizing device is the MICROFLUIDIZER such as Model No. 110T produced by Microfluidics Manufacturing. In this device, the droplets of the first water phase (discontinuous phase) are dispersed and reduced in size in the oil phase (continuous phase) in a high shear agitation zone and, upon exiting this zone, the particle size of the dispersed phase is reduced to uniform sized dispersed droplets in the continuous phase. The temperature of the process can be modified to achieve the optimum viscosity for emulsification of the droplets and to control evaporation of the solvent. For the second step, where the water-in-oil-in-water emulsion is formed the shear or extensional mixing or flow process is controlled in order to prevent disruption of the first emulsion and droplet size reduction is preferably achieved by homogenizing the emulsion through a capillary orifice device, or other suitable flow geometry. The range of back pressure suitable for producing acceptable particle size and size distribution is between 100 and 5000 psi, preferably between 500 and 3000 psi. The preferable flow rate is between 1000 and 6000 mL per minute.

The final size of the particle, the final size of the pores, and the surface morphology of the particle may be impacted by the osmotic mismatch between the osmotic pressure of the inner water phase, the binder polymer/resin oil phase, and the outer water phase. At each interface, the larger the osmotic pressure gradient present, the faster the diffusion rate where water will diffuse from the lower osmotic pressure phase to the higher osmotic pressure phase depending on the solubility and diffusion coefficient of the water in oil phase. If either the exterior water phase or the interior water phase has an osmotic pressure less than the oil phase then water will diffuse into and saturate the oil phase. For the preferred oil phase solvent of ethyl acetate this can result in approximately 8% by weight water dissolved in the oil phase. If the osmotic pressure of the exterior water phase is higher than the binder phase then the water will migrate out of the pores of the particle and reduce the porosity and particle size. In order to increase porosity one preferably orders the osmotic pressures so that the osmotic pressure of the outer phase is lowest, while the osmotic pressure of the interior water phase is highest. Thus, the water will diffuse following the osmotic gradient from the external water phase into the oil phase and then into the internal water phase swelling the size of the pores and increasing the porosity and particle size.

If it is desirable to have small pores and maintain the initial small drop size formed in the step one emulsion then the osmotic pressure of both the interior and exterior water phase should be preferably matched, or have a small osmotic pressure gradient. It is also preferable that the osmotic pressure of the exterior and interior water phases be higher than the oil phase. When using weakly dissociating hydrocolloids such as CMC, one can change the pH of the exterior water phase using acid or a buffer preferably a pH 4 citrate buffer. The hydrogen and hydroxide ions diffuse rapidly into the interior water phase and equilibrate the pH with the exterior phase. The drop in pH of the interior water phase containing the CMC thus reduces the osmotic pressure of the CMC. By designing the equilibrated pH correctly one can control the hydrocolloid osmotic pressure and thus the final porosity, size of the pores, and particle size.

Porous toner particles prepared in accordance with the double emulsion process comprise a solid compositionally continuous polymer binder phase having an external particle surface and discrete pores dispersed within the solid compositionally continuous phase. In accordance with the present invention, the porous toner particles further comprise metallic flake-like particles, and optionally other additives, encapsulated therein. Such metallic flakes, and other additives, may be present primarily in the internal pores, and/or in the polymer binder phase. In a particular embodiment, such metallic flakes may conveniently be introduced by incorporation into the first dispersed aqueous solution, because metallic flakes may have hydrophilic surfaces making them hard to incorporate into the hydrophobic binder phase. Such embodiment of the invention accordingly enables effective incorporation of metallic flakes at a relatively higher concentration than generally obtained by direct dispersion into the organic phase. For purposes of the present invention, being primarily present in the internal pores requires that the metallic flakes additive (or other specific additive) be present in the internal pores of the particle in a greater amount than it is present in the compositionally continuous polymer binder phase. This may be obtained by incorporating a majority of the specific additive into the first water phase, and having only a minority (and in the extreme, none) of the additive be incorporated into the oil phase in the above described double emulsion process. In accordance with a particular embodiment of the invention, it may be preferred that the additive primarily present in the internal pores of the particle is also substantially absent from the external particle surface. This may be enabled by restricting the additive to be present in the first water phase only in the above described process. A way to further control the particle surface morphology to enable formation of such substantially additive-free particle external surface in the above described process is by controlling the osmotic pressure of the two water phases. If the osmotic pressure of the interior water phase is too low relative to the exterior water phase, e.g., pores formed near the surface may burst to the surface and create an "open pore" surface morphology (surface craters) during drying in the third step of the process, thus resulting in the presence of the additive included in the first aqueous phase being potentially deposited on the particle external surface. The process is thus preferably controlled to minimize formation of such open pores, thus forming particles with primarily closed pores and a substantially pore-free surface shell and additive-free external particle surface.

A third step in the preparation of porous particles in accordance with the double emulsion process involves removal of the solvent that is used to dissolve the binder polymer so as to produce a suspension of uniform porous polymer particles in aqueous solution. The rate, temperature, and pressure during drying will also impact the final particle size and surface morphology. The details of the importance of this process depend on the water solubility and boiling point of the organic phase relative to the temperature of the drying process. Solvent removal apparatus such as a rotary evaporator or a flash evaporator may be used in the practice of this method of this invention. The polymer particles may be isolated after removing the solvent by filtration or centrifugation, followed by drying in an oven at 40° C. that also removes any water remaining in the pores from the first water phase. Optionally, the particles are treated with alkali to remove the silica stabilizer. Optionally, the third step in the preparation of porous particles described above may be preceded by the addition of additional water prior to removal of the solvent, isolation, and drying in order to increase the size of the pores and overall level of porosity.

In an alternative process for forming porous particles, the first aqueous solution comprising at least one additive (in addition to any pore stabilizing hydrocolloid) may be emulsified in a mixture of water-immiscible polymerizable monomers and a polymerization initiator to form the first water in oil emulsion. The resulting emulsion may then be dispersed in an aqueous phase containing stabilizer as described in the second step of the process to form a water-in-oil-in-water emulsion preferably through the limited coalescence process. The monomers in the emulsified mixture are polymerized in the third step, preferably through the application of heat or radiation. The resulting suspension polymerized particles may be isolated and dried as described earlier to yield porous particles. In addition, the mixture of water-immiscible polymerizable monomers can contain the binder polymers listed previously.

The average particle diameter of the porous particles of the present invention may be, for example, 2 to 100 micrometers, preferably 3 to 50 micrometers, and more preferably 5 to 20 micrometers. The porosity of the particles is at least 10%, more preferably between 20 and 90%, and most preferably between 30 and 70%, where such porosity value represents the volume percent of internal void space within the external particle surface.

As describe above, porous particles in accordance with the invention may comprise a solid compositionally continuous polymer binder phase having an external particle surface, and discrete pores dispersed within the solid compositionally continuous phase, forming internal pore surfaces. Additives, distinct from and in addition to any pore stabilizing compound which may be employed in the above described porous particle forming process, may be present primarily in the discrete internal pores of such particles, and further may be substantially absent from the external particle surface. Such additives may comprise, e.g., a functional additive employed in toner or other marking particles, such as at least one of a colorant, a release agent such as a wax, a magnetic particle, or a matting agent. When additives are conventionally employed in toners, their presence on the toner particle surfaces can have inconsistent, and possible adverse, effects on controlling triboelectric charging and material handling properties, along with other electrophotographic performance properties. By restricting the location of the additive to be primarily in the internal pores contained within the compositionally continuous polymer binder phase, the impact of such additives on the triboelectric charging and electrophotographic performance of such particles can be minimized, such that a toner set comprising different toners with different additives, while advantageously exhibiting consistent charging and transfer properties, may be enabled. Porous particles in accordance with the invention may be formed by incorporating an additive which is desirably to be located in the formed porous particles, but which is desired to be substantially absent from the external particle surface, in the first aqueous solution in the above described process. Further, many desired additives are more readily available as aqueous dispersions, and a viable route to incorporating these into chemically prepared toners or other polymer particles is to incorporate them in the first water phase of the multiple emulsion process in accordance with an embodiment of the present invention. Many wax and pigment dispersions, especially wax dispersions, e.g., are easier to make in water and more of these are available commercially. The double emulsion process accordingly opens up a wider window of colorants and other additives for incorporating in toners and other polymeric particles.

Colorants suitable for use in toner particles of the present invention may comprise, e.g., a pigment or dye, as disclosed, for example, in U.S. Reissue Pat. No. 31,072 and in U.S. Pat. Nos. 4,160,644; 4,416,965; 4,414,152; and 4,229,513. As the colorants, known colorants can be used. The colorants include, for example, carbon black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3. Colorants can generally be employed in the range of from about 1 to about 40 weight percent on a total toner powder weight basis, and preferably in the range of from about 2 to about 30 weight percent, and most preferably from 4 to 20 weight percent in the practice of this invention. When the colorant content is 4% or more by weight, a sufficient coloring power can be obtained, and when it is 20% or less by weight, effective transparency can be obtained. Mixtures of colorants can also be used. Non-aqueous soluble colorants employed as an additive in accordance with the invention may be predispersed in the first aqueous phase prior to forming the first emulsion.

Metallic flakes, or platelets, suitable for use in the porous toner particles and electrophotographic printing process of the invention can be from any of the available commercial sources of metallic flakes in powder or in suspension form. The flakes or platelets are substantially 2-dimensional particles, having opposed main surfaces or faces separated by a relatively minor thickness dimension. The flakes used are preferably primarily in the range of from about 2 to 50 microns in main surface equivalent circular diameter (ECD), where the equivalent circular diameter is the diameter of a circle having the same area as the main face. More preferably, the metallic flakes have a main surface equivalent circular diameter primarily in the range of from about 2 to 20 microns, and even more preferably, in the range of from about 3 to 15 microns. Flake or platelet shaped particles are further characterized in having an aspect ratio (ratio of main face equivalent circular diameter to thickness) of at least 2, and more preferably of at least about 5. Commercially available metallic flakes typically may have aspect ratios of from 5 to 40, or even higher. The concentration of the metallic flakes preferably ranges from about 3% to 30%, by weight, based upon the total weight of solids. More preferably, the metallic flakes are used in the amount of 4% to 25%, by weight, based on the total weight of solids.

Examples of usable metallic flakes include those from Ciba Specialty Chemicals, a Division of BASF, such as aluminum flakes METASHEEN 91-0410, in ethyl acetate, and those from NanoDynamics such as copper flakes Grade C1-4000F, 4 μm, solid powder. Other metal flakes include but not are limited to tin, gold, silver, platinum, rubidium, brass, bronze, stainless steel, zinc, and mixtures thereof. In addition to pure metal flakes, metal or metal oxide coated materials such as metallic oxide-coated mica, metallic oxide-coated glass, and mixtures thereof can be used as metallic flakes. A gold tone could be achieved with genuine gold; however, copper and zinc, preferably in the form of an alloy, which depending on the composition could thus be referred to as brass or bronze, may alternatively be used. Preferably, the ratio of copper and zinc fractions in the alloy varies from about 90:10 to about 70:30. As the zinc fraction in the alloy increases, the metallically golden hue changes from a more reddish to a more yellowish or even greenish gold tone. The color of the gold tone may be intensified through a controlled oxidation of the metal. A silver tone could result from the metallic flakes containing among other possibilities, aluminum.

The metallic flakes may be pretreated with compatibilizing materials prior to incorporation in the first water phase or in the oil phase. Such materials can be fatty acids, amides, anhydrides, epoxides, phosphates or amines. The compatibilizer may further be a dispersant having an HLB number of at least 8. The HLB number of a dispersant is a measure of the hydrophilic/lipophilic balance of the dispersant and can be determined as described in "Polymeric Surfactants," Surfactant Science Series, volume 42, page 221, by I. Piirma. The general classes of preferred dispersants are water-soluble or water-dispersible surface active polymers. The preferred dispersants are amphipathic in nature. Such a dispersant comprises in its molecule both an oleophilic group and a hydrophilic group of sufficient lengths to provide a large enough steric barrier to interparticle attraction. The dispersant may be nonionic or ionic in nature. These amphipathic dispersants are generally block copolymers, either linear or branched and have segmented hydrophilic and oleophilic portions. The hydrophilic segment may or may not comprise ionic groups and the oleophilic segment may or may not comprise polarizable groups. Such dispersants are believed to function essentially as steric stabilizers in protecting the dispersion against formation of elastic and other flocs leading to increased viscosity of the aqueous dispersion. Ionic groups, if present, in the hydrophilic segment of the dispersant provide added colloidal stabilization through ionic repulsion between the dispersed particles. The polarizable groups, if present, in the oleophilic segment of the dispersant further enhance association of the dispersant through these anchoring sites with any flocculation-prone metallic particles that may be polar in nature. Preferred dispersants comprise various poly(ethylene oxide) containing nonionic and anionic block copolymers. Particularly preferred are dispersants having anionic groups. Most preferred are phosphated alkyl or aryl phenol alkoxylates such as SYNFAC 8337 obtained from Milliken Chemical, Spartanburg, S.C.

Various additives generally present in electrophotographic toner may also be added to the continuous polymer phase of the porous toner particles of the invention, such as charge control agents, waxes and lubricants. Suitable charge control agents are disclosed, for example, in U.S. Pat. Nos. 3,893,935; 4,079,014; 4,323,634; 4,394,430 and British Patents 1,501,065; and 1,420,839. Additional charge control agents which are useful are described in U.S. Pat. Nos. 4,624,907; 4,814,250; 4,840,864; 4,834,920; 4,683,188 and 4,780,553. Mixtures of charge control agents can also be used. Charge control agents are generally employed in small quantities such as from about 0.1% to 10% by weight based upon the weight of the total solids and preferably from about 0.2% to about 3.0%.

Waxes useful in the present invention include low-molecular weight polyolefins such as polyethylene, polypropylene and polybutene; silicone resins which can be softened by heating; fatty acid amides such as oleamide, erucamide, ricinoleamide, and stearamide; vegetable waxes such as carnauba wax, rice wax, candelilla wax, Japan wax, and jojoba oil; animal waxes such as bees wax; mineral and petroleum waxes such as montan wax, ozocerite, ceresine, paraffin wax, microcrystalline wax, and Fischer-Tropsch wax; and modified products thereof. Irrespective to the origin, waxes having a melting point in a range of from 30 to 150 ° C. are preferred and those having a melting point in the range of from 40 to 140 ° C. are more preferred. The wax may be used in the amount of, for example, 1 to 20% by weight, and preferably 2 to 15% by weight, based on the total particle weight. The wax may be incorporated into the toner through several ways. The wax may be first dispersed in an appropriate polymer binder by melt compounding and then mixed with the solvent to form the organic phase. It may also be separately processed into a dispersion form in an organic solvent, with appropriate dispersing aids for incorporation into the organic phase, or in water for incorporation into the first aqueous phase. In all cases the wax exists in the final particle as fine solid particles.

In an alternative process, porous particles containing encapsulated metallic flakes may be formed by a spray and freeze drying process as described in Patent Pub. No. US 2011/0262654, based on U.S. Ser. No. 12/766,944, filed Apr. 26, 2010, the disclosure of which is incorporated by reference herein. In such process, a polymer material is dissolved in an organic solvent to form an organic phase to which are added metal or metallic flakes to form a suspension, and droplets of the resulting suspension are formed by, e.g., spraying the suspension through a capillary nozzle. The droplets are frozen by spraying into a cold environment where the solvent in the droplets is rapidly frozen to form frozen solvent domains within the polymer, and the resulting cold solid drops are dried, preferably under reduced pressure, so that the solvent is removed and porous polymer particles are collected.

The inventive metallic flake containing porous toner particles may be applied to a substrate by a digital printing process, preferably an electrostatic printing process, more preferably by an electrophotographic printing process as described in L. B. Schein, Electrophotography and Development Physics, 2nd Edition, Laplacian Press, Morgan Hill, Calif., 1996 (ISBN 1-885540-02-7); or, by a coating process, preferably an electrostatic coating process, more preferably by an electromagnetic brush coating process as described in U.S. Pat. No. 6,342,273, issued on Jan. 29, 2002, the disclosure of which is hereby incorporated by reference. The method for producing an electrophotographic image in accordance with an embodiment of the invention in particular may comprise the steps of: producing an electrostatic latent image on a primary imaging member; developing the electrostatic latent image by bringing the latent image into close proximity with porous toner particles containing encapsulated metallic flakes to form a developed image comprising the porous toner particles; electrostatically transferring the developed image to a suitable substrate; and permanently fixing the developed image to the substrate by fusing the porous toner particles to the substrate.

The metallic flake containing porous toner particles of the invention are suitable for both two component and monocomponent developers. The visible or developed toned image can be transferred from the primary imaging member directly to a final receiver such as paper, transparency stock, metal, various polymers and thermoset materials, etc. While transfer can be effected using a thermal or thermal assisted process, as is known in the art, it is preferable to use electrostatic transfer. While this can be accomplished using known means such as a corona charger, it is preferable to use an electrically biased transfer roller to press the receiver into contact with the image-bearing primary imaging member while applying an electrostatic field. In an alternative mode of practicing this invention, the developed toner image may be first transferred to a transfer intermediate member, which can serve as a receiver, but not as a final receiver, and then from the transfer intermediate member to the final receiver.

For fixing of the toner image to the surface of the final receiver substrate a contact fusing method like heated roller fusing may be used, or a non-contact fusing method like an oven, hot air, radiant, flash, solvent, or microwave fusing. The image typically is fixed to the final receiver by heating the marking particles to a temperature above the glass transition temperature of the toner particles. The glass transition temperature of the toner particles preferably may be between 45° C. and 70° C., more preferably between 50° C. and 65° C., and most preferably between 50° C. and 58° C. In accordance with one embodiment of the invention, use of porous toner particles comprising encapsulated metallic flakes and voids provide space for the flake-like pigments to re-orient within the binder to be more parallel with the receiver substrate surface upon high temperature fusing, yielding prints that exhibit a higher metallic hue and luster or sheen effect. In accordance with a further embodiment, use of such metallic flake containing porous toner particles may be employed to form a relatively electrically conductive patterned image, such as a printed circuit, by a similar electrophotographic printing process. In such further embodiment, the re-orientation of the metallic flakes upon fusing similarly results in the flakes being aligned more parallel with the substrate, resulting in better electrical contact between metallic flakes, and increased conductivity of the printed circuits. For even higher reflectivity or when decreased electrical resistance is desired, the image can be cast against a heated smooth web or roller, using known techniques described in the literature.

The process of the present invention will now be more particularly described with reference to some examples which might reveal further inventive features, but to which the present invention is not restricted in its scope.

The Kao Binder N polyester resin used in the examples below was obtained from Kao Specialties Americas LLC a part of Kao Corporation, Japan. Carboxymethyl cellulose molecular weight approximately 250K as the sodium salt, was obtained from Aqualon (Hercules). NALCO 1060, a colloidal silica, was obtained from Nalco as a 50 weight percent dispersion. The aluminum flakes OBRON SF-121 (average particle size 9 microns) were obtained from Cameo Chemicals. SYNFAC 8337 was obtained from Milliken Chemical, Spartanburg, S.C. The wax used in the examples was the ester wax WE-3® from NOF Corporation. The charge control agent was FCA 2508N obtained from Fujikura Kasei, Japan. Other chemicals were purchased from Aldrich and used as received.

Preparation of wax dispersion: To a glass jar containing a mixture of WE-3 wax (Nippon Oil and Fats, 25.0 g), TUFTEC P2000 dispersant (AK Elastomer, 5.0 g), and ethyl acetate (70.0 g) were added zirconia beads (diameter about 1.2 mm, 100 mL). The container was then placed on a (Sweco) powder grinder and the wax milled for three to five days. Afterwards, the beads were removed by filtration through a screen and the resulting solid particle dispersion recovered and particles have an average diameter of 0.55 microns.

EXAMPLE 1

(Invention) Porous Toner Containing Aluminum Flakes

A multiple emulsion process in conjunction with an evaporative limited coalescence (ELC) process as described above was used to prepare the porous toner of this example. A first water phase (W1) was prepared using 37.5 g of a 4 wt % carboxymethyl cellulose solution in water along with 34.6 grams of water, and a premixed paste of 2.5 grams OBRON SF 121 Aluminum flakes and 5 grams SYNFAC 8337. The oil phase was made up using 141.7 g of 29.6% solution of Kao N resin in ethyl acetate, 16.4 grams of a dispersion of 24.4% WE-3 wax in ethyl acetate containing 20 wt % P2000 dispersant based on wax, 0.75 grams of a charge control agent FCA 2508N and 88.5 g ethyl acetate. To this oil phase was added the W1 phase followed by mixing with a Silverson L4R Mixer fitted with a large holed disintegrating head. A part (326 g) of the resulting water-in-oil (W1/O) emulsion was gently stirred into 544 grams of a water phase (W2) comprising 10.4 grams of NALCO 1060 in a pH 4 citrate/phosphate buffer using magnetic stirring. The ethyl acetate was evaporated using a Buchi ROTA VAPOR RE120 at 30° C. under reduced pressure to yield porous particles with discrete pores and multiple domains of metallic flakes in the particle. The internal pore structure of particles made by such a multiple emulsion process are illustrated in the Figures of U.S. Patent Application Publications 2008/0176157, 2008/0176164, and 2010/0021838 incorporated by reference above. The silica on the surface of the toner was removed at pH 12 using 1N potassium hydroxide for 15 min. The particles were then washed and dried. The median particle size measured using the Horiba LA-920 was 56 micrometers.

EXAMPLE 2

(Comparative) Solid Toner Containing Aluminum Flakes

Kao N resin was dissolved in ethyl acetate and was added as a 29.6% solution to a premixed paste of 2.5 grams OBRON SF 121 Aluminum flakes and 5 grams SYNFAC 8337. To this was added and mixed in 16.4 grams of a dispersion of 24.4% WE-3 wax in ethyl acetate containing 20 wt % P2000 dispersant based on wax followed by 0.75 grams of a charge control agent FCA 2508N. This resulting oil phase was dispersed in 534 grams of a pH 4 citrate/phosphate buffer comprising 10.5 grams of NALCO 1060 followed by magnetic stirring. The ethyl acetate was evaporated using a Buchi ROTA VAPOR RE120 at 30° C. under reduced pressure to yield solid particles of Kao N containing metal flakes. The silica on the surface of the toner was removed by stirring for 15 min at pH12.5 using potassium hydroxide. The particles were then washed and dried. The median particle size measured using the Horiba LA-920 was 67 micrometers.

Fusing: Solid vs. Porous Toners Containing Metal Flakes

Figure 2:
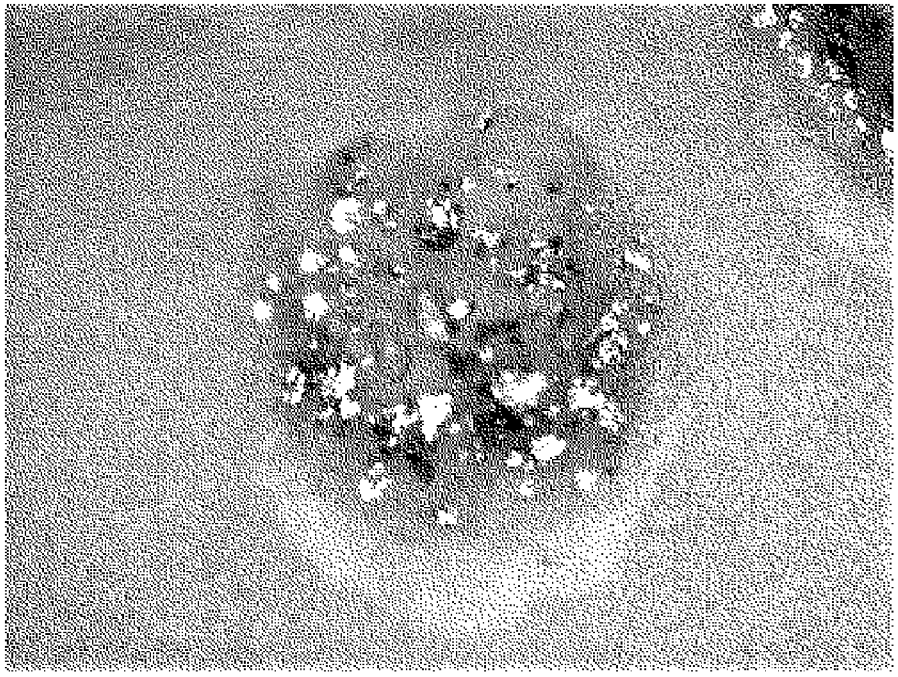
FIG. 2 is a reflective optical image of a fused toner image formed from a porous toner particle comprising metallic flakes in accordance with an embodiment of the present invention.

In order to demonstrate the ability of the metal flakes to reflect light upon fusing, porous (Example 1) and solid (Example 2) samples were first prepared by spreading an excess of particles over the surface of 118 gsm Lustrogloss substrate using a conventional stainless steel coating block and a doctor blade possessing a 10 mil gap. The use of the doctor blade ensured that a uniform layer of particles was created on each substrate. After the samples were produced, they were both passed through the nip of an internally-heated offline fuser breadboard at 185 C. This fuser breadboard consisted of an upper, internally-heated fuser roller possessing a spray-coated fluoropolymer coating and a lower stainless steel pressure roller. For fusing consistency, the upper fuser roller was driven by a commercially-available gear motor and the steel pressure roller was free-turning. After this fusing step, both samples were examined with reflected light optical microscopy. Particular attention was paid to the orientation of the metal flakes within the fused regions. FIGS. 1 and 2 are reflective optical images of a fused toner particle formed from the comparison solid toner particle (Example 2) and from the porous toner particle comprising metallic flakes in accordance with the invention (Example 1), respectively. As is evident from such reflective optical images, the toner particle in accordance with the present invention exhibited greater reflectivity due to increased alignment of the metallic flakes with the substrate surface, which results in an improved metallic look for images formed with such toner particles.

The invention has been described in detail with particular reference to certain preferred embodiments thereof, but it will be understood that variations and modifications can be effected within the spirit and scope of the invention.

The invention claimed is:

1. A toner particle having an external particle surface and comprising a polymer binder phase and metallic flakes encapsulated within the external particle surface of the toner particle, wherein the toner particle further comprises discrete pores formed within the toner particle, such that the toner particle has an internal porosity of at least 10 percent by volume; and wherein the metallic flakes are present at a concentration of from about 3% to about 30% by weight relative to that of the polymer binder phase.

2. The toner particle according to claim 1, wherein the polymer binder phase comprises a solid compositionally continuous phase, and the discrete pores are dispersed within the solid compositionally continuous phase.

3. The toner particle according to claim 2, wherein the metallic flakes are present primarily in the discrete pores.

4. The toner particle according to claim 2, further comprising a pore stabilizing hydrophilic colloid.

5. The toner particle according to claim 1, further comprising a charge control agent.

6. The toner particle according to claim 1, further comprising a wax and a charge control agent.

7. The toner particle according to claim 1, wherein the metallic flakes are substantially 2-dimensional particles, having opposed main surfaces separated by a relatively minor thickness dimension, and have a main surface equivalent circular diameter primarily in a range of from about 2 microns to about 20 microns, and an aspect ratio of at least 2.

8. The toner particle according to claim 7, wherein the metallic flakes have an aspect ratio of at least about 5.

9. The toner particle according to claim 1, where the metallic flakes comprise copper or aluminum.

10. The toner particle according to claim 1, wherein the particle has an internal porosity of from 20 to 90 percent.

* * * * *